US011253875B2

(12) United States Patent
Wildgen et al.

(10) Patent No.: US 11,253,875 B2
(45) Date of Patent: Feb. 22, 2022

(54) MULTI-DIMPLE ORIFICE DISC FOR A FLUID INJECTOR, AND METHODS FOR CONSTRUCTING AND UTILIZING SAME

(71) Applicant: Continental Powertrain USA, LLC, Auburn Hills, MI (US)

(72) Inventors: Andreas Wolfgang Wildgen, Regensburg (DE); Robert Wayne McFarland, Smithfield, VA (US); Dennis Brian Dezern, Smithfield, VA (US)

(73) Assignee: Vitesco Technologies USA, LLC, Auburn Hills, MI (US)

( * ) Notice: Subject to any disclaimer, the term of this patent is extended or adjusted under 35 U.S.C. 154(b) by 220 days.

(21) Appl. No.: 16/517,141

(22) Filed: Jul. 19, 2019

(65) Prior Publication Data

US 2020/0030823 A1 Jan. 30, 2020

Related U.S. Application Data

(60) Provisional application No. 62/711,453, filed on Jul. 27, 2018.

(51) Int. Cl.
*B05B 1/14* (2006.01)
*B05B 1/30* (2006.01)
(Continued)

(52) U.S. Cl.
CPC ..... *B05B 1/14* (2013.01); *B05B 1/3046* (2013.01); *B21D 35/001* (2013.01);
(Continued)

(58) Field of Classification Search
CPC ..... F02M 61/168; F02M 61/1813; F02M 61/182; F02M 61/1846; F02M 61/1853;
(Continued)

(56) References Cited

U.S. PATENT DOCUMENTS 4,621,772 A * 11/1986 Blythe ..... F02M 61/1853 239/585.4
5,201,806 A * 4/1993 Wood ..... F02M 61/1853 123/470
(Continued)

FOREIGN PATENT DOCUMENTS

EP 1118767 A2 7/2001

OTHER PUBLICATIONS

International Search Report and Written Opinion of the International Searching Authority dated Oct. 1, 2019 for corresponding PCT Application No. PCT/US2019/043683.

*Primary Examiner* — Darren W Gorman

(57) ABSTRACT

A fluid injector for injecting fluid is disclosed, including a body; a fluid passageway defined in the body and extending from an inlet to an outlet of the fluid injector; a valve seat disposed internally of the body and forming part of the passageway; a valve element that is selectively reciprocated relative to the valve seat to close and open the passageway to fluid flow by seating and unseating the valve element on and from the valve seat, respectively; and an orifice disc disposed in the passageway downstream of the valve seat in a direction of the fluid flow through the fluid injector, the orifice disc including a plurality of dimples and a plurality of orifices defined through the orifice disc, each dimple including at least one orifice located thereon and each dimple having an asymmetrical cross-section.

12 Claims, 9 Drawing Sheets

(51) Int. Cl.

| | |
|---|---|
| ***F02M 61/16*** | (2006.01) |
| ***F02M 61/18*** | (2006.01) |
| ***B21D 35/00*** | (2006.01) |
| *F02M 51/06* | (2006.01) |

(52) U.S. Cl.
CPC ..... *F02M 61/168* (2013.01); *F02M 61/1853* (2013.01); *F02M 51/0625* (2013.01)

(58) Field of Classification Search
CPC .. F02M 2200/8053; B05B 1/14; B05B 1/3046
See application file for complete search history.

(56) References Cited

U.S. PATENT DOCUMENTS

| | | | | |
|---|---|---|---|---|
| 5,489,065 | A * | 2/1996 | Nally, Jr. ..... | F02M 61/1853 239/552 |
| 7,048,202 | B2 * | 5/2006 | Bierstaker ..... | F02M 51/0671 239/494 |
| 7,163,159 | B2 * | 1/2007 | Joseph ..... | F02M 51/0671 239/494 |
| 7,201,329 | B2 * | 4/2007 | Joseph ..... | F02M 61/1853 239/494 |
| 8,567,701 | B2 * | 10/2013 | Hashii ..... | F02M 61/1853 239/601 |
| 2004/0217213 | A1 * | 11/2004 | Nally ..... | F02M 61/1846 239/585.1 |
| 2004/0262430 | A1 | 12/2004 | Joseph | |
| 2006/0192036 | A1 | 8/2006 | Joseph | |
| 2011/0253812 | A1 | 10/2011 | Sakata | |
| 2018/0171954 | A1 * | 6/2018 | Mulye ..... | F02M 61/1853 |
| 2018/0272365 | A1 * | 9/2018 | Schriver ..... | F02M 61/12 |

* cited by examiner

MULTI-DIMPLE ORIFICE DISC FOR A FLUID INJECTOR, AND METHODS FOR CONSTRUCTING AND UTILIZING SAME

CROSS REFERENCE TO RELATED APPLICATION

The present application claims the benefit of and priority to U.S. provisional patent application 62/711,453, filed Jul. 27, 2018, and titled "Multi-Dimple Orifice Disc for a Fluid Injector," the content of which is incorporated by reference herein in its entirety.

FIELD OF INVENTION

The present invention generally relates to an orifice disc for a fluid injector, and particularly to an orifice disc having multiple dimples on which orifices are defined.

BACKGROUND

Fluid injectors are typically used to introduce fluid into a desired location, such as fluid into the combustion chamber of a gas combustion engine or a reductant into the exhaust stream of a vehicle having such an engine. To operate most effectively, injection systems require good atomization of the fluid being injected. Spray generation, or atomization, is created by the fluid stream breaking into droplets, while being directed in a specific direction. Breakup of the fluid stream is enhanced by keeping the fluid turbulent as it exits the fluid injector.

Some existing fluid injectors include a disc or plate which may have several exit orifices through which the fluid passes as the fluid exits the fluid injector. Some of these discs include a protrusion or dimple along which the orifices are located. The size and shape of the orifices as well as their locations along the dimple, together with the size and shape of the dimple, at least partly define the spray pattern of fluid exiting the fluid injector. These existing fluid injectors, however, are limited in failing to allow for the production of fluid spray patterns for any of a large number of fluid injection applications.

SUMMARY

According to example embodiments, there is disclosed a fluid injector for injecting fluid, including a body; a fluid passageway defined in the body and extending from an inlet to an outlet of the fluid injector; a valve seat disposed internally of the body and forming part of the passageway; a valve element that is selectively reciprocated relative to the valve seat to close and open the passageway to fluid flow by seating and unseating the valve element on and from the valve seat, respectively; and an orifice disc disposed in the passageway downstream of the valve seat in a direction of the fluid flow through the fluid injector, the orifice disc including a plurality of dimples and a plurality of orifices defined through the orifice disc, each orifice being disposed on a dimple and each dimple having an asymmetrical cross-section.

Each dimple may be a ramped protrusion which extends from a flat surface of the orifice disc. Each dimple may have a maximum depth and height which are axially offset from a radial center of the orifice and of the dimple. For each dimple, a radial distance between a center longitudinal axis of the disc and a first axis extending in an axial direction and passing through the maximum depth/height of the dimple is less than a distance between the center longitudinal axis of the disc and a second axis extending in an axial direction and passing through a radial center of the dimple.

Each orifice may have a longitudinal axis that is at an oblique angle relative to a radial axis of the disc.

The number of dimples may be between four and ten.

The disc may include an upstream surface and a downstream surface, each dimple may include a first inner surface that is at least partly elliptical through which the orifice is disposed, and an opening along the upstream surface that is circular. The first inner surface may be disposed at an angle between 1 degree and 15 degrees to the upstream surface.

Each dimple may include an inclined protrusion which protrudes or extends from the downstream surface and forms a cavity along the upstream surface.

Other example embodiments are directed to an orifice disc for a fluid injector, including a disc member including a plurality of dimples and a plurality of orifices defined through the disc member, each dimple including an orifice located thereon and each dimple having an asymmetrical cross-section. Each dimple may have a maximum depth and height which are axially offset from a radial center of the orifice and from a radial center of the dimple. For each dimple, a radial distance between a center longitudinal axis of the disc and a first axis extending in an axial direction and passing through the maximum depth/height of the dimple is less than a distance between the center longitudinal axis of the disc member and a second axis extending in an axial direction and passing through a radial center of the dimple.

Another example embodiment is directed to a method of forming an orifice disc for a fluid injector, including performing a plurality of first punch operations on the disc, each first punch operation forming an orifice defined through the disc; and performing a plurality of second punch operations. Each second punch operation forms a dimple on the disc such that the disc includes a plurality of dimples, each dimple including an orifice defined therethrough. Each second punch operation includes positioning a punch member having a largely cylindrical shape and a distal, flat contact surface that is at an oblique angle relative to a longitudinal axis and a radial axis of the disc, and moving the punch member towards the disc in an axial direction to the disc that is parallel to the longitudinal axis of the disc and orthogonal to the radial axis of the disc. Each dimple formed includes an inclined protrusion which extends from the disc. Each inclined protrusion extends from the disc at an angle between 1 degree and 15 degrees.

BRIEF DESCRIPTION OF THE DRAWINGS

Aspects of the invention will be explained in detail below with reference to an exemplary embodiment in conjunction with the drawings, in which.

DETAILED DESCRIPTION

The following description of the preferred embodiment(s) is merely exemplary in nature and is in no way intended to limit the invention, its application, or uses.

Example embodiments are generally directed to an orifice disc disposed at the outlet end of a fluid injector which affects the spray pattern of the fluid discharged from the injector.

It is understood that references to "upstream" and "downstream" herein are relative to the flow of a fluid through the fluid injector. It is further understood that "and/or" means at least one of, such that "A and/or B" means "A, B, or both A and B." Similarly, "A, B and/or C" means "A, B, C, both A and B, both A and C, both B and C, or all of A and B and C."

Figure 1:
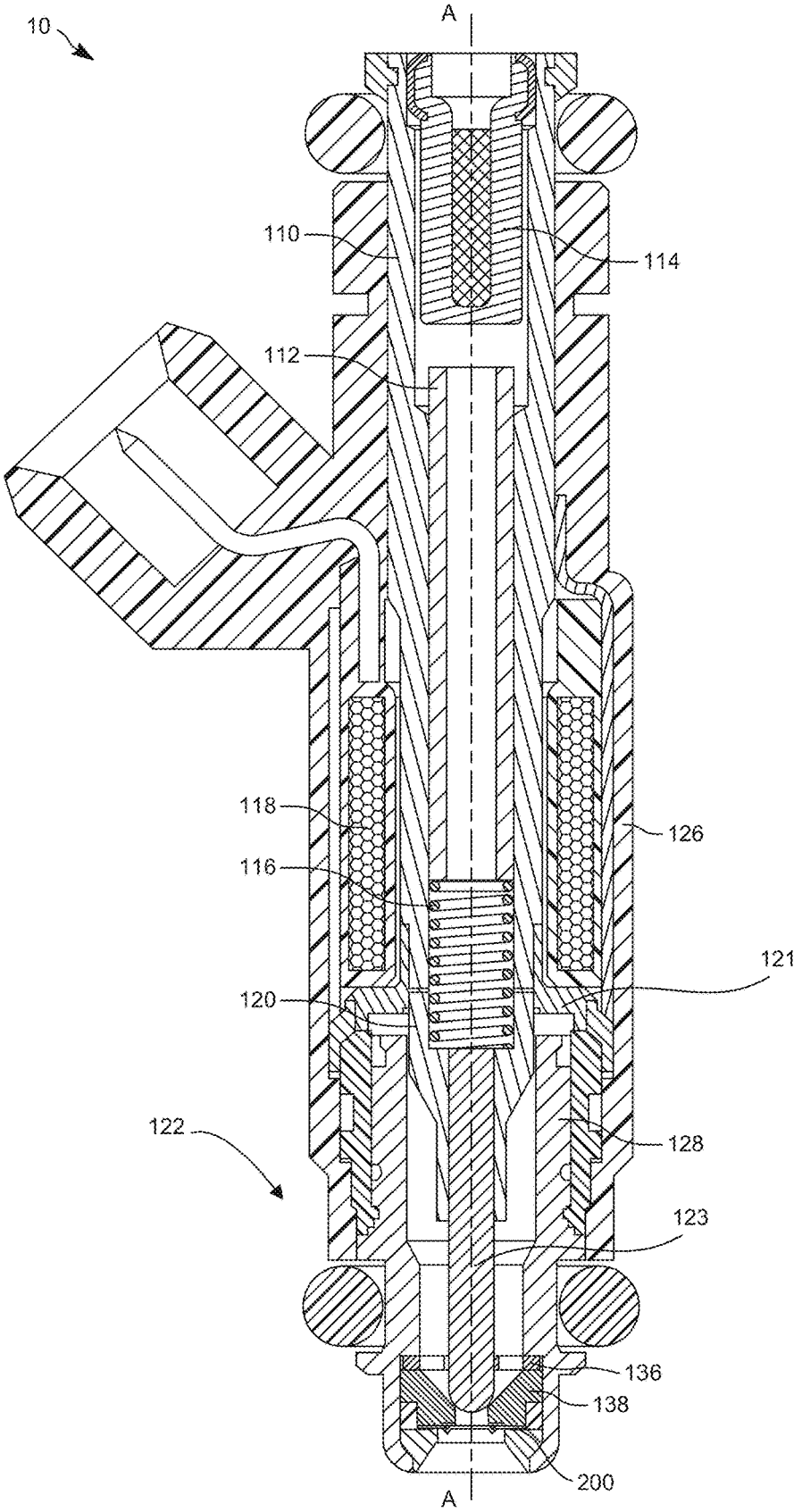
FIG. 1 is a cross-sectional side view of a fluid injector according to an example embodiment.
Figure 1A:
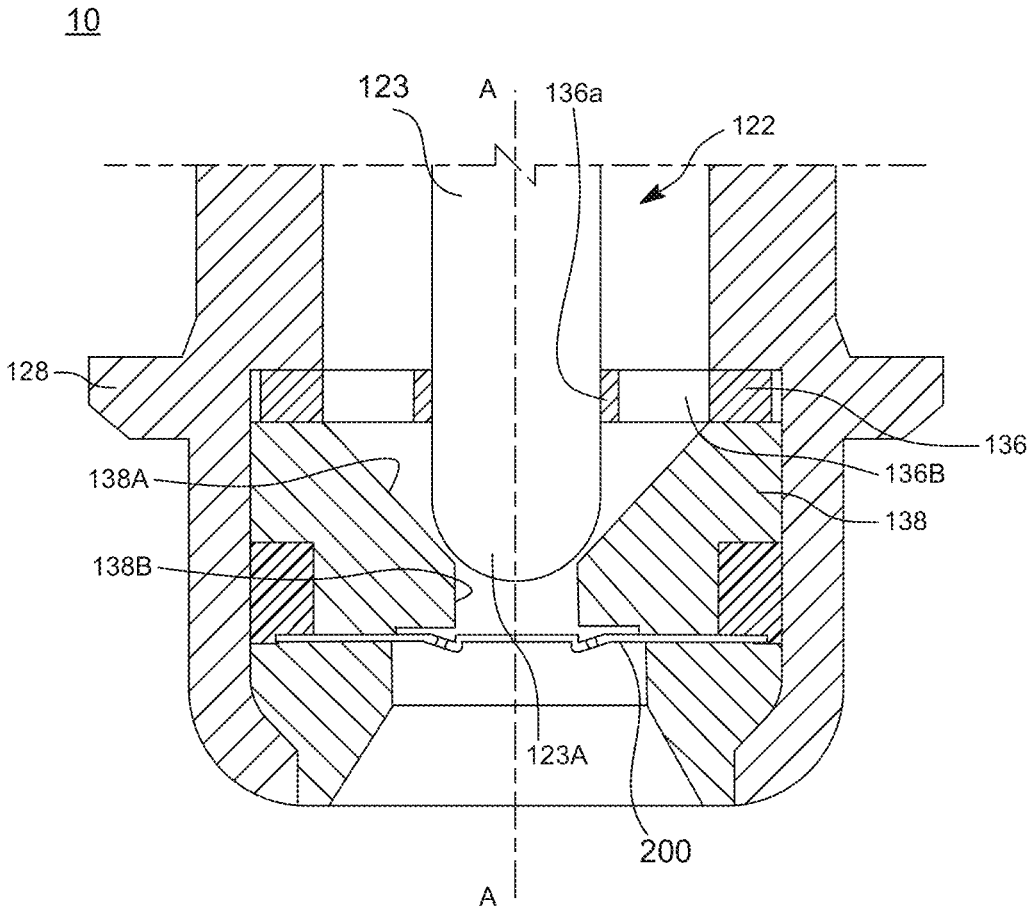
FIG. 1A is an enlarged view of an outlet portion of the fluid injector of FIG. 1.

FIGS. 1 and 1A illustrate a solenoid-actuated fluid injector 10 according to an example embodiment. In particular, fluid injector 10 includes: a fluid inlet tube or body 110 which receives a fluid at an inlet of the injector; a calibration adjustment tube 112; a filter assembly 114 for filtering the fluid entering the fluid injector 10; a fluid injector overmold 126 which largely houses the components of the fluid injector; and a coil 118 forming part of the solenoid actuator along with a movable armature 120, pole piece 121 and a spring 116. Passing a current through coil 118 creates an electromagnetic field which causes armature 120 to move towards pole piece 121 against the spring force of spring 116. Elimination of the coil current removes the electromagnetic force and causes armature 120 to move in response to the spring force from spring 116 in a direction away from pole piece 121. A fluid passageway is defined between the inlet of fluid injector 10 to an outlet thereof. A valve assembly 122 includes a valve body 128 in which a movable closure member 123, which is coupled to armature 120, and a valve seat 138 are disposed. Valve body 128 and fluid inlet tube 110 define an injector body having the fluid passageway which extends from the injector inlet to the injector outlet. The valve assembly 122, under control by the solenoid actuator, is selectively switched between an open state in which fluid in fluid injector 10 exits the injector, and a closed state in which fluid is preventing from exiting the injector. Specifically, movement of armature 120 towards pole piece 121 in response to electromagnetic forces from passing current through coil 118 causes closure member 123 to be spaced apart from valve seat 138, such that valve assembly 122 is in the open state. Movement of armature 120 away from pole piece 121 in response to the absence of current in coil 118 causes spring 116 to move armature 120 in a direction away from pole piece 121 until closure member 120 sealingly engages with valve seat 138 such that valve assembly 122 is in the closed state. The construction of fluid injector 10 can be of a type similar to those disclosed in commonly assigned U.S. Pat. Nos. 4,854,024; 5,174,505; and 6,520,421, which are incorporated by reference herein in their entireties.

FIG. 1A shows the fluid outlet end of the valve body 128 of fluid injector 10 according to an example embodiment. The outlet end of fluid injector 10 includes an orifice disc 200, a guide member 136 and the valve seat 138, the latter two of which are disposed axially interiorly of orifice disc 200. The guide member 136, valve seat 138 and orifice disc 200 may be retained in fluid injector 10 by a suitable technique such as, for example, by welding the orifice disc 200 to the valve seat 138 and welding the valve seat 138 to the valve body 128.

Valve seat 138 may include a frusto-conical shaped seating surface 138A that leads from guide member 136 to a central passage 1388 of the valve seat 138 that, in turn, leads to orifice disc 200. Guide member 136 includes a central guide opening 136A for guiding the axial reciprocation of a sealing end 123A of the closure member 123, and several through-openings 1368 distributed around opening 136A to provide for fluid to flow into the sac volume. The fluid sac volume is the encased volume downstream of the sealing seat perimeter of the closure member 123, which in this case is the volume between the interface of sealing end 123A and seating surface 138A, and the metering orifices of orifice disc 200. FIG. 1A shows the hemispherical sealing end 123A of closure member 123 displaced from sealing surface 138A, thus allowing fluid flow from fluid injector 10.

Figure 2:
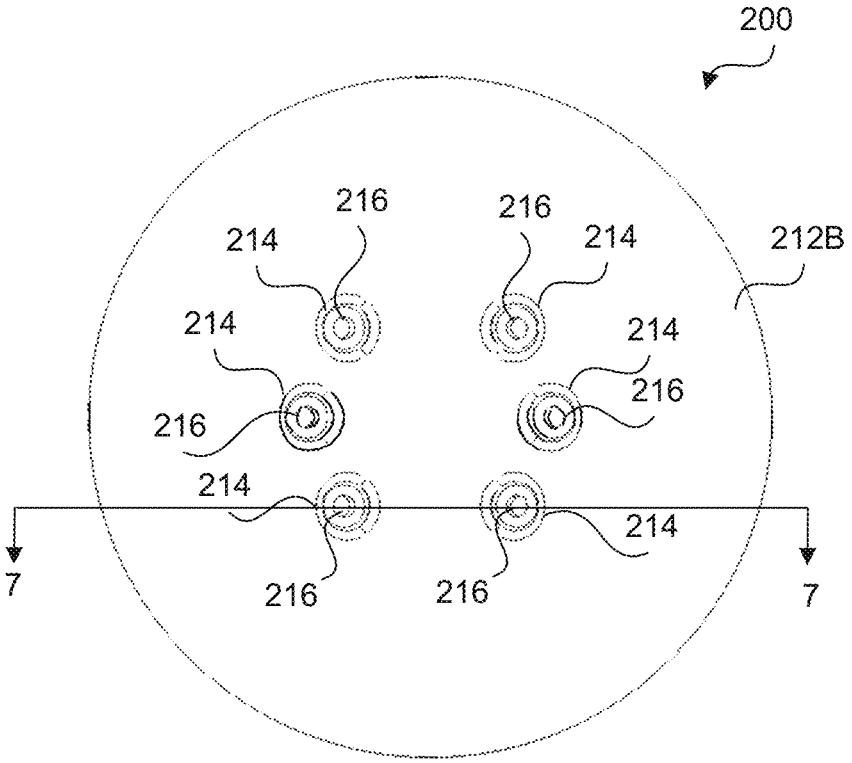
FIGS. 2 and 3 are bottom plan and top perspective views, respectively, of an orifice disc in the fluid injector of FIG. 1, according to an example embodiment.
Figure 3:
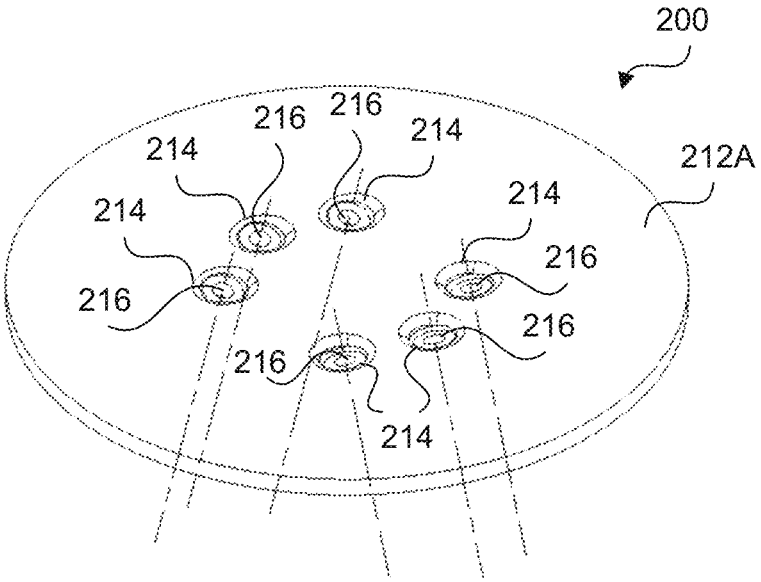
Figure 4:
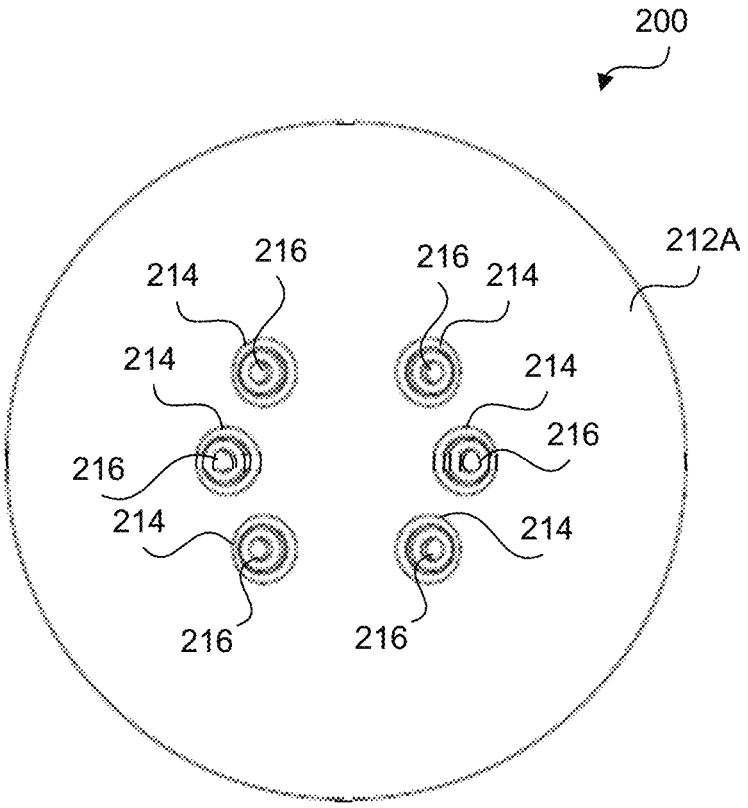
FIG. 4 is a top plan view of an orifice disc in the fluid injector of FIG. 1, according to an example embodiment.

FIGS. 2-7 illustrate orifice disc 200 according to example embodiments. Orifice disc 200 is constructed from a metal or metal composition and has punched features defined thereon. As can be seen, orifice disc 200 is largely flat, including flat surfaces 212A and 212B. In the example embodiment illustrated, flat surface 212A faces upstream within fluid injector 10 and flat surface 212B faces downstream. Orifice disc 200 further includes a plurality of protrusions or dimples 214. Dimples 214 extend or protrude from flat portions 212A and 212B in the direction of fluid flow through injector 10. In an example embodiment, dimples 214 of the orifice disc 200 of FIGS. 2-4 are evenly distributed about and surround a radial center of orifice disc 200. Each dimple 214 includes a concave inner surface defined along the upstream surface 212A of orifice disc 200 and a convex outer surface defined along and protruding from the downstream surface 2128 of orifice disc 200. Though FIGS. 2-4 depict orifice disc 200 as including six dimples 214, it is understood that orifice disc 200 may include more or less than six dimples 214. Specifically, orifice disc 200 may include between four and ten dimples 214. The number and particular locations of dimples 214 along orifice disc 200 relative to a center of the disc may depend upon the particular fluid injector 10 in which orifice disc 200 is to be used as well as the spray pattern desired for fluid exiting the injector.

In an example embodiment, each dimple 214 has an asymmetric shape. Specifically, the cavity of each dimple 214 has an angled, at least partial cylindrical shape. This angled cylindrical shape is disposed at an oblique angle relative to the radial and longitudinal axes of orifice disc 200 as well as the longitudinal axis A of fluid injector 10. The particular oblique angle may be between 1 degree and 20 degrees, such as between 5 degrees and 15 degrees, relative to a radial axis of orifice disc 200 as well as a lateral axis of fluid injector 10. Stated another way, each dimple 214 is an inclined protrusion or ramp portion extending from flat portion 212B of orifice disc 200, with an incline/ramp angle being an oblique angle relative to the radial and longitudinal axes of orifice disc 200. From a cross sectional perspective as shown in FIGS. 5 and 7, the ramp portion may have a largely right triangular shape.

The angled positioning of the partial cylindrical shape of dimples 214 results in a maximum cavity depth and height of dimple 214 that is offset relative to a center of the cavity of dimple 214 along the upstream surface 212A of orifice disc 200. In an example embodiment, the dimples 214 are oriented on orifice disc 200 so that the deepest part of each dimple 214 is closer to the radial and axial center of the disc. It is understood, however, that dimples 214 may be oriented differently on the disc.

Figure 5:
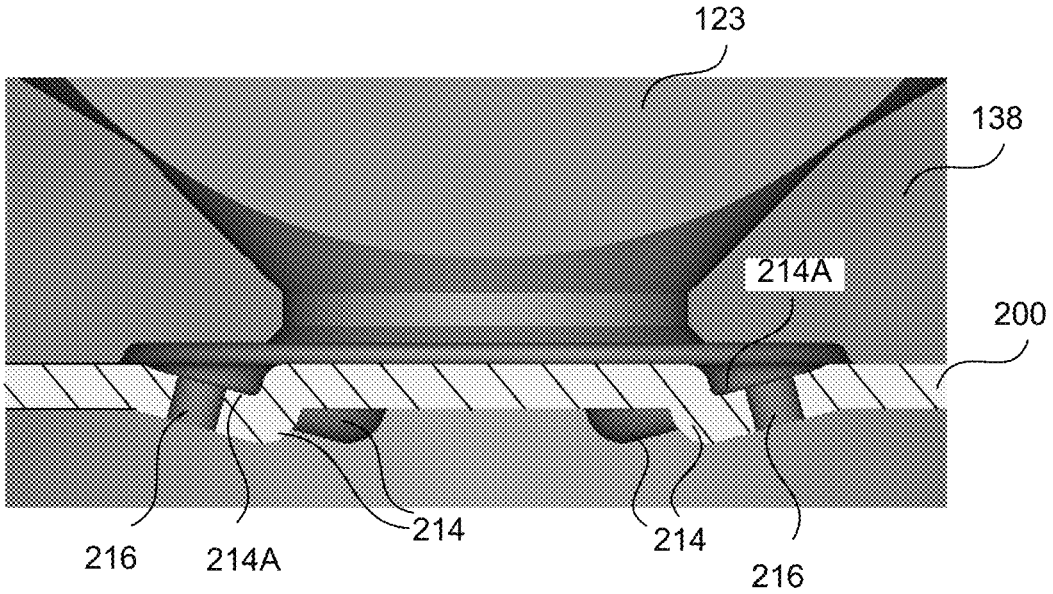
FIG. 5 is a cross-sectional view of an outlet portion of a fluid injector according to another example embodiment.
Figure 7:
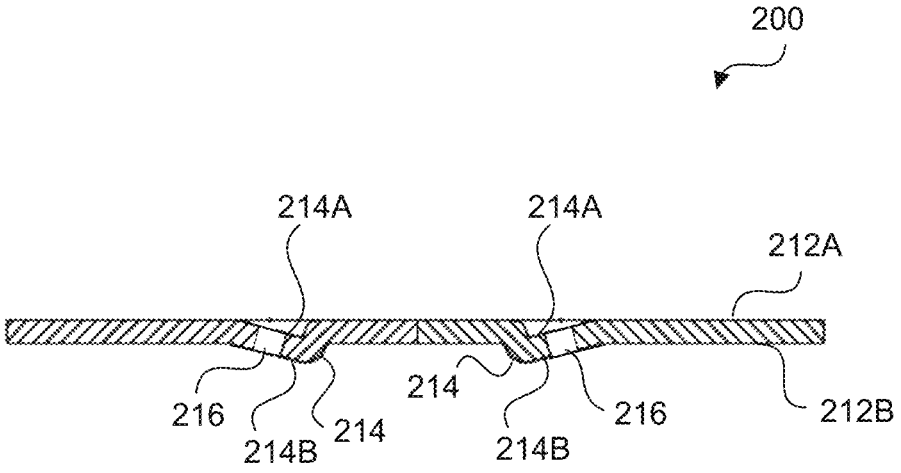
FIG. 7 is a cross-sectional view of the orifice disc of the fluid injector of FIG. 1 taken along the 7-7 line in FIG. 2.

As shown in FIGS. 5 and 7, each dimple 214 includes an inner surface 214A which at least partly defines the shape of the cavity created by dimple 214. In an example embodiment, inner surface 214A has at least a partial elliptical shape, oval shape and/or oblong shape. The inner surface 214A is inclined at an oblique angle relative to the radial and longitudinal axes of orifice disc 200 and longitudinal axis A of fluid injector 10. Each dimple 214 further includes a corresponding outer surface 214B which is disposed opposite the corresponding inner surface 214A. In an example embodiment, outer surface 214B has the same or similar shape and angular position as corresponding inner surface 214A.

Figure 6:
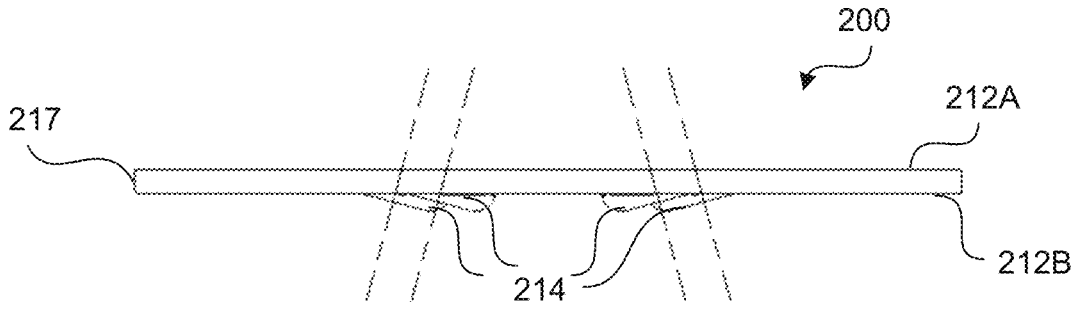
FIG. 6 is a side view of the orifice disc of the fluid injector of FIG. 1.

With continued reference to FIGS. 2-7, orifice disc 200 further includes a plurality of orifices 216 defined through the disc. In the illustrated embodiment, each dimple 214 includes a single orifice 216. It is understood, however, that in other embodiments, each of one or more dimples 214 may include more than one orifice 216. Best seen in FIGS. 5 and 7, each orifice 216 is defined through inner surface 214A and outer surface 2148 of the corresponding dimple 214. Orifices 216 provide for fluid in fluid injector 10 to exit the injector via the fluid outlet thereof. With each orifice 216 being disposed along a dimple 214, a longitudinal axis of each orifice 216 is disposed at an oblique angle relative to the radial and longitudinal axes of orifice disc 200 as well as the longitudinal axis A of fluid injector 10. In addition or in the alternative, the longitudinal axis of each orifice 216 forms skew lines with each of the longitudinal axis of orifice disc 200 and the longitudinal axis of fluid injector 10. In an example embodiment, dimples 214 are arranged and oriented on orifice disc 200 such that fluid passing through each dimple is directed radially outwardly, in a direction towards the outer radial surface and/or circumferential side surface 217 of orifice disc 200, as shown in FIGS. 3 and 6. The angled disposition of orifices 216 allows for a split spray pattern of fluid exiting fluid injector 10, with improved atomization.

Each dimple 214 is sized smaller than dimples in existing orifice plates. In an example embodiment, each dimple 214 may have a diameter between 300 microns and 500 microns, such as 400 microns. In an example embodiment, each orifice 216 has a diameter that is between 140 microns and 180 microns. The thickness of orifice disc 200 may be between 100 microns and 200 microns.

In an example embodiment, all of the dimples 214 are the same size. It is understood, however, that two or more dimples 214 may have different shapes, different depths or both different shapes and different depths. In another embodiment, two or more dimples 214 may have different shapes, different dimensions, or both different shapes and different dimensions.

A method 600 of forming orifice disc 200 will be described with reference to FIGS. 8-12. Though method 600 includes a number of steps or acts which are presented in a particular order, it is understood that the order of steps may vary from the depicted order.

Figure 8:
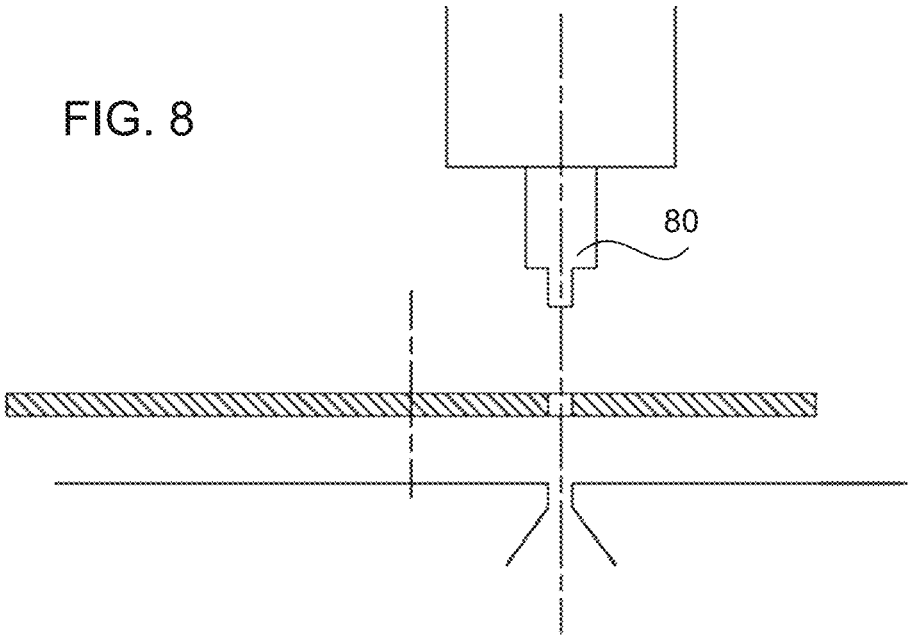
FIGS. 8 and 9 illustrate steps of forming the orifice disc of the fluid injector of FIG. 1, according to an example embodiment.
Figure 12:
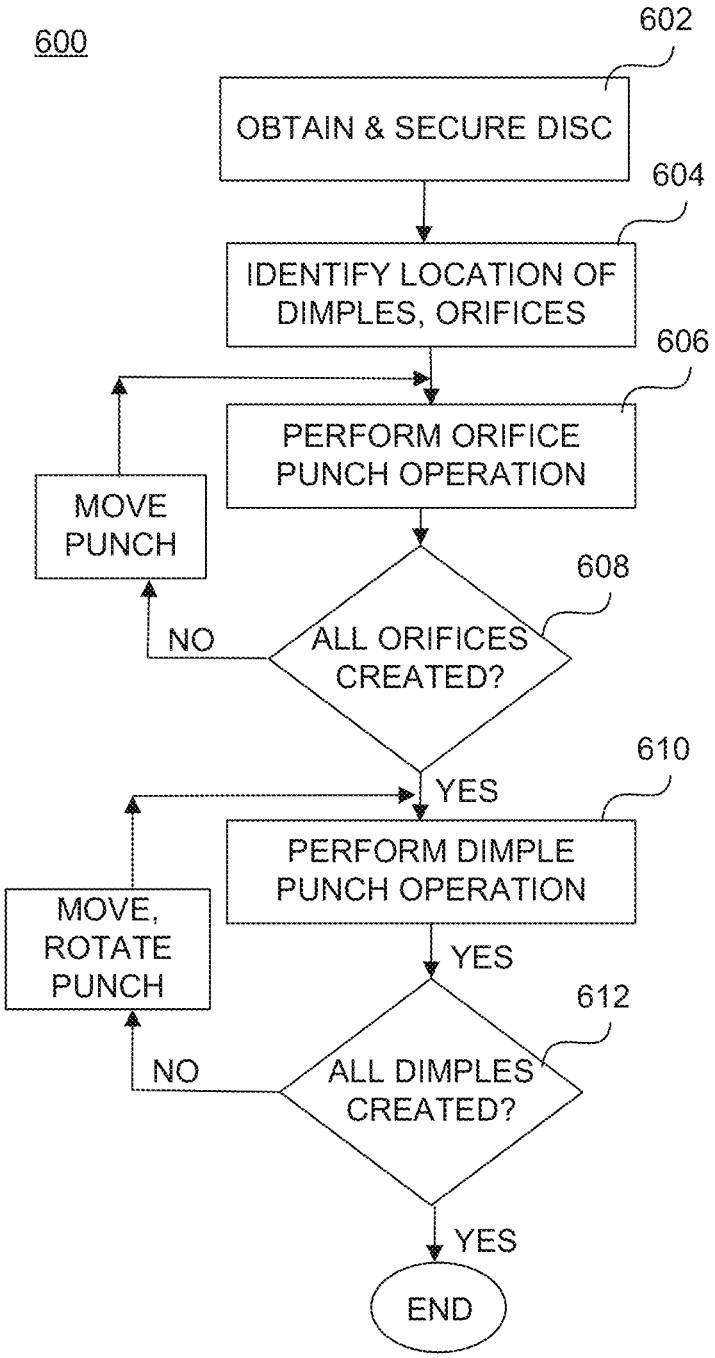
FIG. 12 is a flowchart depicting a method of making the orifice discs of FIG. 1 according to an example embodiment.

Referring to FIG. 12, method 600 begins at 602 with obtaining and suitably securing a blank disc to be worked. The location of the dimples 214 and orifices 216 to be formed on the blank disc are identified at 604. Next, a set or series of orifice punch operations are performed at 606. Each orifice punch operation 606 forms a single orifice 216. FIG. 8 illustrates a punch operation to form a single orifice on a blank disc. The punch operations may be performed serially in time, as illustrated in FIG. 12, or simultaneously. If serial orifice punch operations 606 are performed, between punch operations the punch member 80 may be moved to the next desired orifice location on the disc. If desired, method 600 may also optionally include, between punch operations, switching between different punch members so as to form orifices having different shapes and sizes. In an example embodiment, the punch member 80 used in each orifice punch operation 606 punches through the disc in a direction that is orthogonal to the flat surfaces of the disc. Stated another way, the punch member used in each punch operation 606 punches through the disc in an axial direction of the disc.

Figure 9:
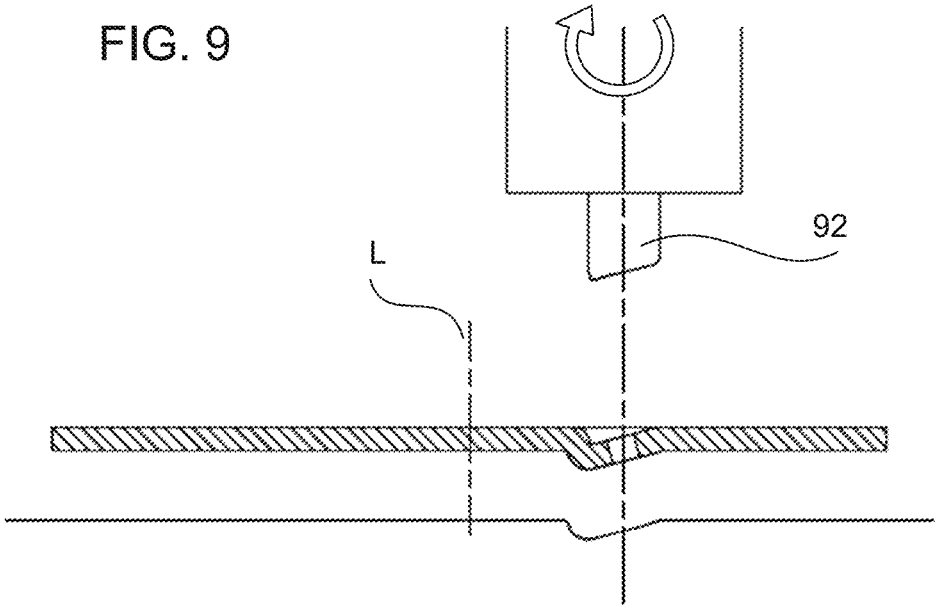

Method 600 further includes performing a set or series of dimple punch operations at 608. Each dimple punch operation 608 forms a single dimple 214. The dimple punch operations 608 may be performed serially in time, as depicted in FIG. 12, or simultaneously. FIG. 9 illustrates a single dimple punch operation to form a dimple 214 on the disc. It is noted that the punch member 92 (FIG. 9) is largely cylindrical in shape with a distal end that is at an oblique angle relative to the radial and longitudinal axes of the disc. The distal end of the largely cylindrically shaped punch member 92 may be seen as being truncated by a plane that is disposed at an oblique angle with a plane corresponding to flat surface 212A and to flat surface 2128 of disc 200, thereby forming an outer, flat contact surface of punch member 92 that is similarly disposed at the oblique angle. This oblique angle may be between 1 degrees and 15 degrees relative to a radial axis of the disc, and to flat surfaces 212A and 2128 thereof. With the punch member 92 having a largely cylindrical shape, the angled distal end portion provides punch member 92 with a contact surface that has an elliptical, oval and/or oblong shape. This forms the dimple 214 having the shape as described above. The use of a largely cylindrical punch member 92 having a slanted contact surface that is at an oblique angle advantageously allows for the punch member 92 to be moved in a direction that is parallel to the longitudinal axis L of the disc 200 and orthogonal to a radial axis of disc 200 in order to form the dimple 214 having the shape as described above.

If serial punch operations are performed, between punch operations the punch member 92 may be moved to the location on the disc for the next dimple 214 to be formed, and punch member 92 may be rotated about its longitudinal axis as needed. Alternatively, dimples 214 are formed at the same time in a single dimple punch operation.

Figure 10:
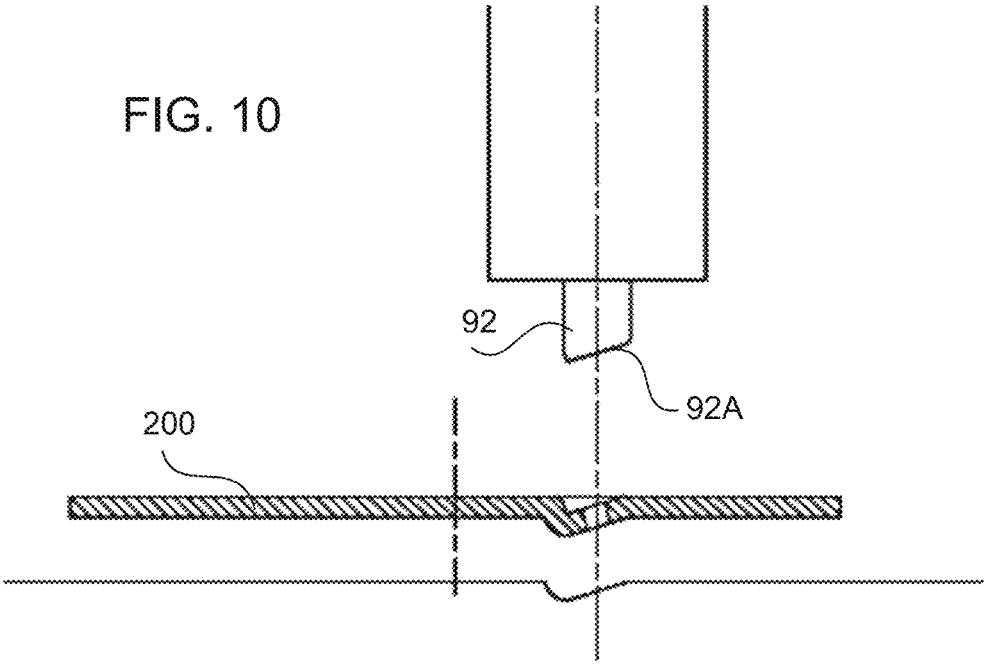
FIGS. 10 and 11 illustrate a dimple forming step for the orifice disc of the fluid injector of FIG. 1, according to example embodiments.
Figure 11:
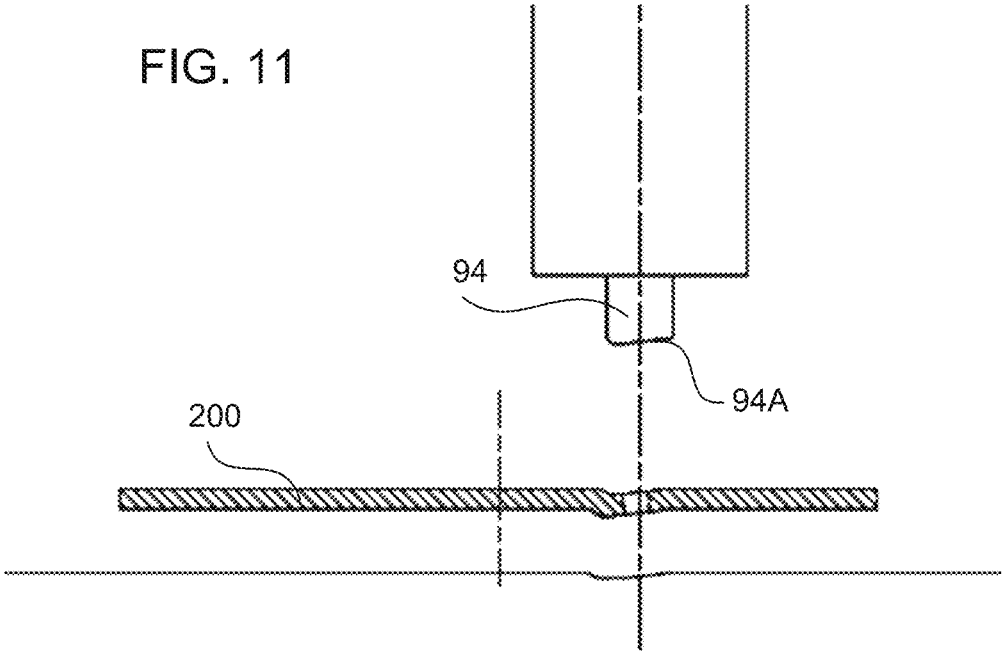

FIG. 10 illustrates use of a punch member 92 having a contact surface 92A that is at 15 degrees from a radial axis or direction of disc 200. FIG. 11 illustrates use of a punch member 94 having a contact surface 94A that is 5 degrees from a radial axis or direction of disc 200. It is understood that punch member 92, punch member 94 and/or punch members having contact surfaces at other angles may be used in forming dimples 214 of an orifice disc 200.

With orifice disc 200 having the dimples and orifices 216 as described, the fluid exiting fluid injector 200 has a split stream spray pattern with appreciable atomization. It is understood that the number, location and orientation of dimples 214, and the size and location of orifices 216 along corresponding dimples 214 may be chosen to achieve the desired spray pattern for the particular fluid injector application.

The use of a plurality of smaller dimples 214, relative to existing orifice plates using a single, relatively large dimple, results in the fluid sac volume, corresponding to the encased volume downstream of the sealing seat perimeter along seating surface 138A of valve seat 138, which in this case is the volume between the interface of sealing end 123A of the closure member 123 and seating surface 138A, and orifices 216 of orifice disc 200, being advantageously reduced.

Fluid injector 10, including orifice disc 200, may be a fuel injector for injecting fuel into the combustion chamber of a gas combustion engine. Alternatively, fluid injector 10 may be an injector for a reductant delivery unit of a selective catalytic reduction system in which a reductant is injected into the exhaust stream of a vehicle's exhaust line for reducing the vehicle's nitrogen oxide emissions. Further, fluid injector 10 may be used in other applications in which a fluid injector is utilized.

Figure 13:
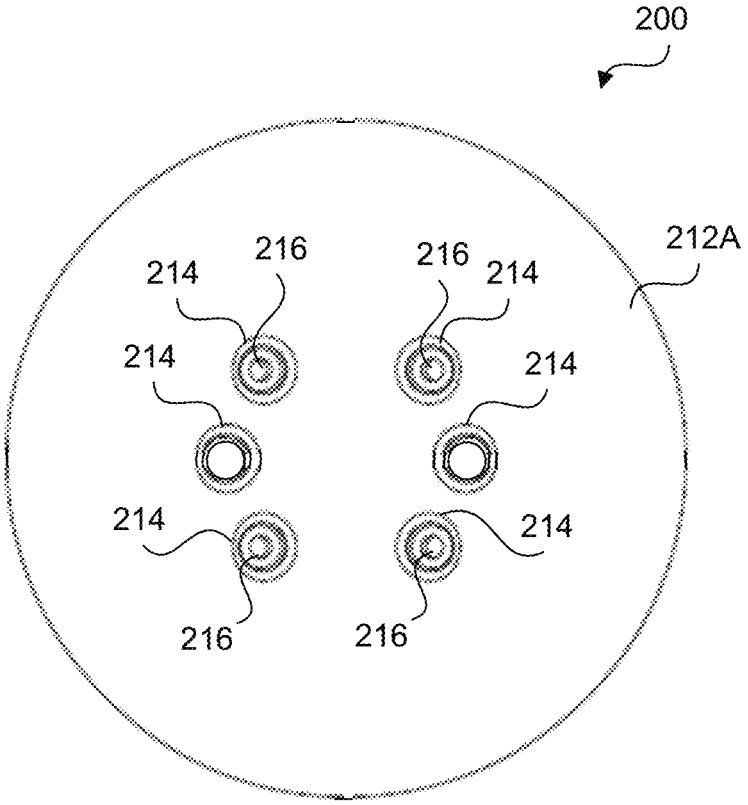
FIG. 13 is a top plan view of an orifice disc of the fluid injector of FIG. 1 according to another example embodiment.

For the orifice disc 200 described above, each dimple 214 includes an orifice 216. In another example embodiment, one or more dimples 214 does not include an orifice 216 disposed thereon. FIG. 13 illustrates an orifice 200 in which two dimples 214 do not include an orifice 216 defined thereon. By using only six of eight dimples 214, a spray could be created that fits another, different application. The unused dimples 214 do not have a purpose, but they will also not adversely impact the resulting spray pattern. The orifice disc 200 may be thus used for more than one product—one requiring a spray pattern provided by six used dimples 214 and another application requiring a spray pattern provided by four used dimples 214.

It is understood that the particular dimensions of the components illustrated in the drawings, and particularly the dimensions of dimples 214 and orifices 216 appearing on orifice disc 200, are not necessarily to scale so as to better show the component features and characteristics.

The example embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

What is claimed is:

1. A fluid injector for injecting fluid, the fluid injector comprising:

a body;

a fluid passageway defined in the body and extending from an inlet to an outlet of the fluid injector;

a valve seat disposed internally of the body and forming part of the fluid passageway;

a valve element that is selectively reciprocated relative to the valve seat to close and open the passageway to fluid flow by seating and unseating the valve element on and from the valve seat, respectively; and an orifice disc disposed in the fluid passageway downstream of the valve seat in a direction of the fluid flow through the fluid injector, the orifice disc including a plurality of dimples and a plurality of orifices defined through the orifice disc, each orifice is disposed along a dimple and each dimple has an asymmetrical cross-section, wherein the disc includes an upstream surface and a downstream surface, and each dimple includes a first inner surface that is at least partly elliptical and an opening along the upstream surface that is circular.

2. The fluid injector of claim 1, wherein each dimple includes a single orifice located thereon.

3. The fluid injector of claim 1, wherein each dimple has maximum depth which is axially offset from a radial center of the dimple.

4. The fluid injector of claim 3, wherein for each dimple, a radial distance between a center longitudinal axis of the disc and a first axis extending in an axial direction of the disc and passing through the maximum depth of the dimple is less than a distance between the center longitudinal axis of the disc and a second axis extending in an axial direction and passing through a radial center of the dimple.

5. The fluid injector of claim 1, each orifice has a longitudinal axis that is at an oblique angle relative to a radial axis of the disc.

6. The fluid injector of claim 1, wherein a number of the dimples is between four and ten.

7. The fluid injector of claim 1, wherein the disc includes an upstream surface and a downstream surface, and each dimple includes a first inner surface that is disposed at an angle between 1 degree and 15 degrees to the upstream surface.

8. The fluid injector of claim 1, wherein the disc includes an upstream surface and a downstream surface, and each dimple comprises an inclined protrusion which protrudes from the downstream surface and forms a cavity along the upstream surface.

9. An orifice disc for a fluid injector, the orifice disc comprising:

a disc member including a plurality of dimples and a plurality of orifices defined through the disc member, each dimple including at least one orifice located thereon and each dimple having an asymmetrical cross-section, wherein the disc includes an upstream surface and a downstream surface, and each dimple includes a first inner surface that is at least partly elliptical and an opening along the upstream surface that is circular.

10. The orifice disc of claim 9, wherein each dimple has maximum depth which is axially offset from a radial center of the dimple.

11. The orifice disc of claim 9, wherein for each dimple, a radial distance between a center longitudinal axis of the disc and a first axis extending in an axial direction and passing through a maximum depth of the dimple is less than a distance between the center longitudinal axis of the disc member and a second axis extending in an axial direction and passing through a radial center of the dimple.

12. The orifice disc of claim 9, further comprising at least one other dimple disposed on the disc member, the at least one other dimple having an asymmetrical cross-section and without an orifice defined therethrough.

* * * * *